US008011662B2

(12) United States Patent
Black

(10) Patent No.: US 8,011,662 B2
(45) Date of Patent: Sep. 6, 2011

(54) THREE DIMENSIONAL MAZE PUZZLE AND GAME

(75) Inventor: David N Black, Powell, TN (US)

(73) Assignee: David N Black, Powell, TN (US)

( * ) Notice: Subject to any disclaimer, the term of this patent is extended or adjusted under 35 U.S.C. 154(b) by 229 days.

(21) Appl. No.: 12/507,280

(22) Filed: Jul. 22, 2009

(65) Prior Publication Data

US 2011/0018197 A1 Jan. 27, 2011

(51) Int. Cl.
*A63F 7/04* (2006.01)
*A63F 9/06* (2006.01)

(52) U.S. Cl. ..... 273/153 R; 273/113

(58) Field of Classification Search ..... 273/153 R, 273/109, 113, 115, 116, 117, 441
See application file for complete search history.

(56) References Cited

U.S. PATENT DOCUMENTS 794,919 A * 7/1905 Blakeney ..... 273/113
3,406,971 A * 10/1968 Koff ..... 273/153 R
3,785,651 A * 1/1974 Smith ..... 273/153 R
3,827,694 A * 8/1974 Lemelson ..... 273/113
D245,436 S * 8/1977 Zelenko ..... D21/340
4,311,310 A * 1/1982 Dankman et al. ..... 273/153 R
4,511,143 A * 4/1985 Sankrithi ..... 273/153 R
5,310,184 A * 5/1994 Grist ..... 273/153 R
5,732,945 A * 3/1998 Sofia ..... 273/153 R
5,839,723 A * 11/1998 Grimes ..... 273/153 R

* cited by examiner

*Primary Examiner* — Steven Wong

(57) ABSTRACT

A hand-held opaque playing board has a different maze structure on each of two faces with holes passing through the board between the two maze structures. Each maze structure is divided approximately in half by an impassable barrier. Gravity moves the playing piece when the board is tilted. When the ball passes through the board from one maze structure to the other, the board must be turned over to view the other maze structure. The ball must travel from the start position at one end on one face through the maze structures back and forth through the board until the playing pieces lands in the finish position at the other end on the other face in the shortest time. The maze can also be played on a hand-held electronic device or on a stationary screen device, such as a computer, using a controller to simulate tilting and turning the board.

9 Claims, 7 Drawing Sheets

THREE DIMENSIONAL MAZE PUZZLE AND GAME

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to games and puzzles and particularly to a three dimensional maze puzzle and game which comprises a two-sided maze structure having a different maze on two faces of a center two-sided opaque planar playing board interconnected with openings through the playing board for a ball to drop from a first maze structure on a first face of the playing board to a second maze structure and a second face of the playing board and back again repeatedly with the playing board tipped upside down to alternate which face is up to play the maze that is face up, each maze structure having two separate maze fields divided by an impassable barrier with the maze barrier on the first face in a different location than the maze barrier on the second face so that a player, using a hand-held game comprising a casing with a clear cover over each of the maze faces with the player tilting the casing to cause the ball to roll through the passageways of each of the maze structures and enter one of the openings to drop to the opposite maze structure on the opposite face below, turning the double maze structure casing upside down repeatedly back and forth and traversing the maze passageways with the object being to start with the ball at one end of the casing in a start indentation on a starting maze structure on top face of the playing board and to land the ball in a finish indentation at an opposite end of the playing board in the finish maze structure on the bottom face of the playing board, or a player using an electronic simulation of the two sided maze to simulate the same play, in both cases the object being to accomplish the start to finish two sided maze travel in the shortest time.

2. Description of Related Art Including Information Disclosed Under 37 CFR 1.97 and 1.98

Typically, a handheld maze or labyrinth is a two-dimensional game that allows a user to move a ball in a maze in a plane, back and forth, to the right and left, but not upwards or downwards in space to another plane. Maze games have also been provided in three dimensional structures to increase the level of difficulty of guiding the ball through the structure wherein the three dimensional structures are entirely exposed to view by a user from a side position.

The prior art does not provide a two sided maze structure with a different maze on each face of an opaque playing board with a middle barrier in each maze on each face dividing each face into two adjacent visible mazes with no passageway from one to the other and with openings through the playing board between the two faces requiring a user to tilt the playing field to roll a ball through each of the mazes and drop the ball from a top face to a bottom face and back and forth repeatedly with only one face visible to a player at a time requiring the player in order to pass from a starting indentation at one end of a top maze and land the ball in a finish indent in an opposite end of the bottom maze in the shortest period of time.

U.S. Pat. No. D250,286, issued Nov. 14, 1978 to Zelenko, shows a design for a maze puzzle having two levels with openings therebetween and a center post through the board.

U.S. Pat. No. 403,012, issued May 7, 1889 to Washburn, concerns a maze game comprising a box divided by a horizontal plate into two compartments, each compartment having a labyrinth channel, the channels of each compartment communicating with each other, and the box having a ball inlet aperture on the first compartment and a ball outlet aperture on the second compartment.

U.S. Pat. No. 794,919, issued Jul. 18, 1905 to Blakeney, provides a bi-level labyrinth puzzle which employs spherical games pieces adapted by proper manipulation of the puzzle to be moved through a labyrinth in the upper tier, through a communicating opening in a horizontal partition to the lower second tier, and through the labyrinth of the second tier to an outlet opening in the second tier.

U.S. Pat. No. 4,066,265, issued Jan. 3, 1978 to Bredlau, indicates an amusement device characterized by a transparent envelope having substantially planar sides, and a maze card of a substantially planar configuration having a maze defined thereon, adapted to be received in the envelope, including means defining along the opposite faces thereof a singular path extended between the periphery and the center of the maze and passing at least once through the card. In one embodiment the path is traced on the board of the envelope employing a marking device, while in an alternate embodiment the path is defined in the card by a gated channel and a ball is seated in the channel and adapted to roll along the path as it traverses along its length.

U.S. Pat. No. 7,338,045, issued Mar. 4, 2008 to Guha, is for a three-dimensional maze game in the form of a hand-held toy. The hand held toy is in the form of a cube. The toy comprises a substantially cubic non-transparent body containing a plurality of intersecting pathways for an object and an entrance aperture and single/multiple exit apertures connecting the pathways wherein each intersection formed by the intersecting pathways is provided with means to bring the object to rest till the toy is tilted and the object follows a vertical pathway that is defined by the tilting of the toy. The object is inserted into an entry point in the toy and the player has to bring the object out through an exit point by following a fixed number of steps in turning the toy. The challenge is to find the correct sequence of turns and considerable amount of mental dexterity is required for the purpose.

U.S. Pat. No. 5,839,723, issued Nov. 24, 1998 to Grimes, claims a multi-layer maze assembly having multiple sets of maze channels that are interconnected.

U.S. Pat. No. 5,310,184, issued May 10, 1994 to Grist, puts forth a transparent prize presenting game having a puzzle or challenge to be solved or completed. The game is capable of presenting a paper prize, such as paper money, stock certificates and the like, thereby motivating a player to solve and complete the puzzle or challenge. The game has a transparent container. The paper prize is removably disposed in the container, so that access thereto without successfully completing the puzzle or challenge is prevented. The puzzle or challenge is disposed in the container. Arrangements are provided that permit access to the paper prize only upon the successful completion of the puzzle or challenge. In this fashion, the user is provided with the motivation of the paper prize to successfully complete the puzzle or challenge.

U.S. Pat. No. 3,218,754, issued Nov. 23, 1965 to Hunter, describes a coin bank wherein a coin is used as a playing piece in a puzzle comprising a two-sided labyrinth.

U.S. Pat. No. 2,011,266, issued Aug. 13, 1935 to Boynton, discloses a maze puzzle comprising a double-faced labyrinth with a switching element that allows the ball to travel from a first labyrinth face to the second labyrinth face.

U.S. Pat. No. 6,575,462, issued Jun. 10, 2003 to Roy, provides a maze structure which may be a handheld game having plural levels, each with a floor and upstanding walls arranged in a maze-like pattern and dividing each level into a plurality of separate chambers. Openings are located in the top and bottom sides of the levels for communication of the chambers of one level with chambers of adjacent levels when the levels are stacked. Having the chambers of adjacent levels being arranged to communicate with one another regardless of the relative orientation of the levels permits any one level to be rotated about a vertical axis in relation to the other levels as well as permitting a plurality of different stacking orders to produce numerous different combinations and different solutions to the maze structure.

U.S. Pat. No. 1,294,013, issued Feb. 11. 1919 to Wittrup, claims a puzzle having an outer box, an inner box having one apertured end, partitions connecting said boxes, one of said partitions being apertured, apertured vertical partitions for said inner box, horizontal partitions connecting said vertical partitions and the walls of the inner box, one of said horizontal partitions being apertured and a ball having a diameter less than any of the aperture.

U.S. Pat. No. 5,732,945, issued Mar. 31, 1998 to Sofia, discloses a toy maze comprising a container with a ball having a plurality of passage levels with vertically extending wall segments forming passageways. Each level is separated by a tray having a plurality of apertures, some of which are trap-holes with a mechanism for limiting the movement of the ball to only one direction. In a preferred embodiment of the toy maze of the present invention, the mechanism for limiting the movement of the ball to only one direction comprises at least one flexible flap which flexes to permit the ball to pass through an aperture from one level to the next level and resiliently blocks reverse movement of the ball.

U.S. Pat. No. D379,381, issued May 20, 1997 to Hermes, indicates the ornamental design for a multi-level maze toy.

U.S. Pat. No. 2,563,608, issued Apr. 7, 1951 to Laufer, puts forth a labyrinth game including a maze or labyrinth of passages through which a coin is moved by a player. The coin can be seen by the player through transparent cover to facilitate his or her solving of the puzzle.

U.S. Pat. No. 615,413, issued Dec. 6, 1898 to Sharpe, illustrates a puzzle board provided with a series of pins and suitably-arranged pockets or receptacles, said pins forming labyrinth paths in which a ball is made to travel by tilting or otherwise manipulation the board, and are thus caused to enter said receptacles or pockets.

U.S. Pat. No. 3,785,651, issued Jan. 15, 1974 to Smith, is for a cube having a maze contained therein through which a ball is movable. The puzzle has a transparent outer enclosure containing the maze and ball. Nontransparent intermediate walls are positioned inwardly of each transparent wall providing a space on each side of the cube in which the ball is freely movable. The nontransparent intermediate walls are provided with the holes through which the ball is passable to the maze within the intermediate walls. One hole is bisected by an inner wall thereby allowing the ball to go in one of two opposite directions. The maze extends vertically and horizontally through the cube.

U.S. Pat. No. 3,787,054, issued Jan. 22, 1974 to Stafford, shows a puzzle having a maze through which a contained ball traverses. A cubicle main body is provided with non-transparent outer walls with a plurality of inner walls mounted therein defining a single non-continuous tortuous passage having a start and finish without any dead end passages. A pair of transparent windows mounted to the outer walls of the main body are positioned at the start and finish of the passage. A ball is positioned within the main body and is movable from the start window through the passage to the finish window. The ball is not removable from the main body. In one embodiment, the inner walls are nontransparent thereby preventing visual determination through the windows of the tortuous passage. In another embodiment, some of the inner walls are transparent allowing a person to visually determine through the windows a portion of the tortuous passage. In another embodiment, all of the inner walls are transparent.

What is needed is a two sided maze structure with a different maze on each face of an opaque playing board with a middle barrier in each maze on each face dividing each face into two adjacent visible mazes with no passageway from one to the other and with openings through the playing board between the two faces requiring a user to tilt the playing field to roll a ball through each of the mazes and drop the ball from a top face to a bottom face and back and forth repeatedly with only one face visible to a player at a time requiring the player to pass from a starting indentation at one end of a top maze and land the ball in a finish indent in an opposite end of the bottom maze in the shortest period of time.

BRIEF SUMMARY OF THE INVENTION

An object of the present invention is to provide a three dimensional puzzle maze played as an individual skill puzzle or a competitive game comprising a two-sided maze structure with a different maze on each face of an opaque planar playing board with a middle barrier in each maze on each face dividing each face into two adjacent visible mazes with no passageway from one to the other and with openings through the playing board between the two faces requiring a user to tilt the playing field to roll a ball through each of the mazes and drop the ball from a top face to a bottom face and back and forth repeatedly with only one face visible to a player at a time requiring the player in order to pass from a starting indentation at one end of a top maze and land the ball in a finish indent in an opposite end of the bottom maze in the shortest period of time, which three dimensional puzzle maze may be played on a hand-held, double-faced casing with a transparent cover over each face manipulated by hand or mechanical means or on an electronic simulation of the same structure in a hand-held device or viewed on a screen.

In brief, an opaque planar playing board with a different maze on each face is fabricated by molding or machining a synthetic or natural material to form the two-sided playing board or to create two different planar maze structures with a maze on one side and flat on the other and securing the flat sides together by conventional means such as using an adhesive or a heat staking process or using mechanical fasteners or by enclosing the two different planar maze structures in a sealed casing. The maze structures may also be constructed on each of two sides of a single flat opaque board or on two boards connected together. The mazes are configured to allow a sphere to roll on the planar playing board through the maze. Holes are drilled or formed in the planar playing board at various locations on the mazes to allow the sphere, a metal or other type of ball, to pass through the holes from one maze face to the other. A transparent cover over each of the two maze faces may be attached over maze configurations with elevated edges or the transparent cover may be part of a casing housing the opaque double-sided maze. The transparent cover retains the ball within each of the maze structures along with elevated edges around the mazes and also enables a user to view one face of the maze at a time. The same configuration and playing characteristics may be simulated electronically in a hand-held device with a viewing screen on two opposing faces and manipulated in the same fashion as the physically constructed, encased maze puzzle or with the two-sided maze puzzle simulated and the motion of the simulated casing viewed on a game screen or computer screen or television screen and played by using electronic control means.

Alternately, a virtual playing board with virtual opposite face maze structures and virtual playing piece is displayed on a screen of an electronic device. A hand-held electronic device with internal motions sensors can be used by tilting the hand-held electronic device to electronically activate the electronic controls to simulate the motion of the virtual playing piece through the virtual mazes. A hand-held electronic device with both a top and a bottom screen shows the two virtual mazes in a similar fashion to a physical version of the invention and must be turned over in a similar fashion when the virtual playing piece travels through a virtual opening from one virtual maze structure to the other. A hand-held electronic device with a single screen can automatically change the image of the virtual mazes each time the virtual playing piece passes from one virtual maze structure to the other.

An electronic device, such as a computer or gaming console, has a stationary viewing screen showing a virtual case housing the virtual playing board with two opposing virtual maze structures to tilt on a stationary screen operated by controls, which may be one or more joy sticks, to cause a virtual playing piece to traverse the maze structures. When the virtual playing piece passes from one virtual maze to the other, a player must manipulate the controls to flip the virtual case over on the screen to view the virtual maze structure containing the virtual playing piece.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
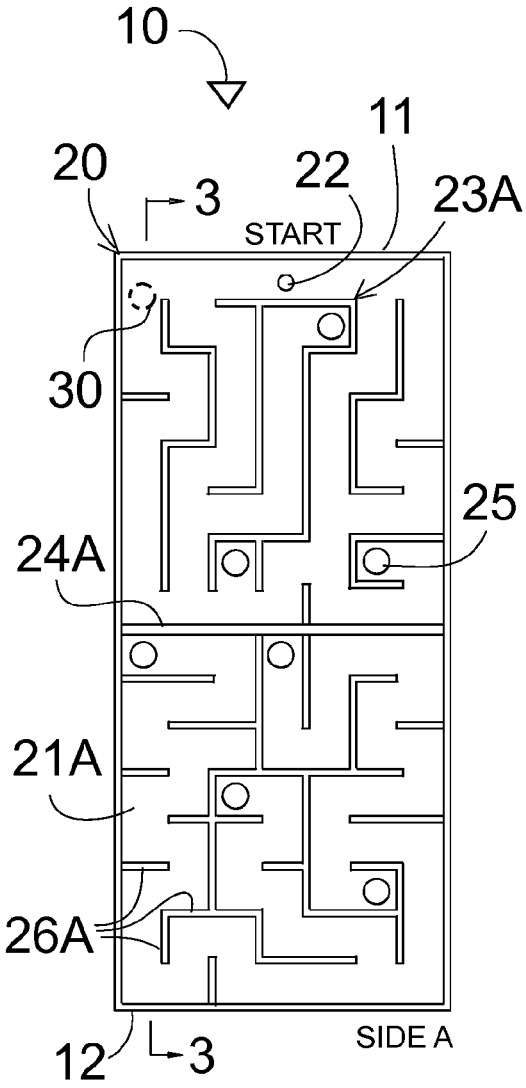
FIG. 1 is a top plan view of the playing board of the present invention showing the top maze structure containing the playing piece and the start position at one end of the playing board.
Figure 2:
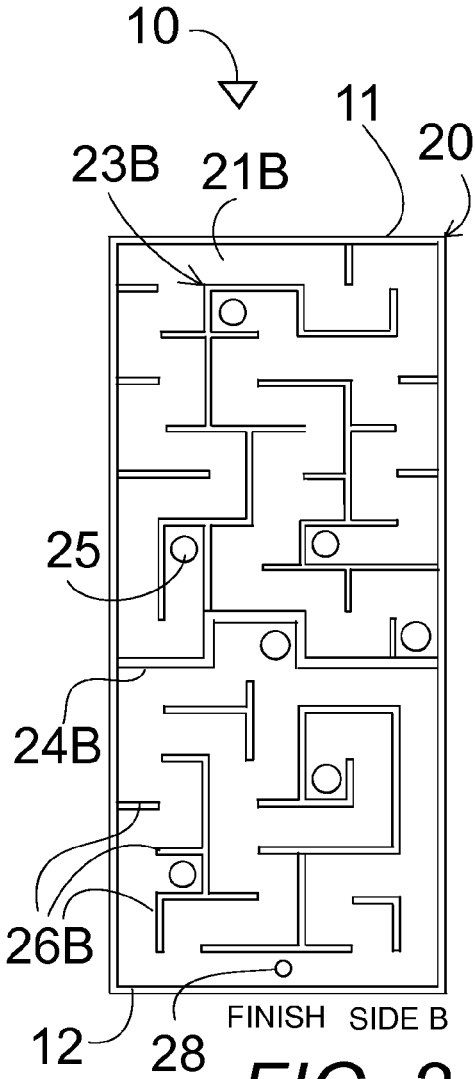
FIG. 2 is a bottom plan view of the playing board of FIG. 1 showing the bottom maze structure containing the finish position at an opposite end of the playing board.

In FIGS. 1-11, a three dimensional puzzle maze game 10, 10A, 10B, and 10C comprises a planar playing board 20 having a different maze structure 23A and 23B on each of two opposing faces of the playing board, with a plurality of openings 25 through the playing board, and a playing piece 30 and 30A to move through the maze structures 23A and 23B and pass through the openings 25 from one maze structure to the other and back.

In FIGS. 1-5, a playing board 20 comprises an opaque planar surface having two opposing faces 21A and 21B and a maze structure 23A and 23B on each of the two opposing faces of the playing board 20. Each of the maze structures 23A and 23B comprises spaced walls 26A and 26B in various orientations and of various lengths to create passageways along the playing board 20 between the spaced walls 26A and 26B with some dead end passageways and some through passageways communicating with other passageways.

In FIGS. 1-5, a playing piece (or ball or sphere) 30 moves on the playing board 20 through each of the maze structures 23A and 23B along the passageways, the playing piece moving in a direction of a downward tilting of the playing board 20. The playing board 20 has a plurality of openings 25 therethrough at various locations to admit the playing piece 30 to pass from a first maze structure 23A on a first face 21A on one side of the playing board to a second maze structure 23B on a second face 21B on the opposing side of the playing board 20 and back. The playing board 20 also comprises edge walls 27 around the outer perimeter of each face 21A and 21B to define the peripheral edge limitations of the maze structure 23A and 23B.

A start location 22 at a first end 11 of the playing board 20 in the first maze structure 23A on the first face 21A is the location for placing the playing piece 30 to start the passage of the playing piece 30 in motion, A finish location 28 at a second end 12 of the playing board 20 in the second maze structure 23B on the second face 21B is the final resting place of the playing piece.

Each of the maze structures 23A and 23B has a barrier wall 24A and 24B extending between the two longer opposing side walls and midway between two ends of each of the maze structures 32A and 23B to prevent the playing piece 30 from moving directly from one end 11 of each of the maze structures 23A and 23B to the other end 12 of the same maze structure on the same face. The barrier wall 24A and 24B on one face 21A is positioned out of vertical alignment with the barrier wall on the other face 21B, thereby requiring the playing piece 30 to pass back and forth through various openings 25 between the maze structures 23A and 23B on the two faces 21A and 21B and traverse the maze structures 23A and 23B in order to move from the start location 22 in the first maze structure 23A on the first face 21A to land on the finish location 28 in the second maze structure 23B on the on the second face 21B at the opposing end of the planar playing board 20.

The object of the game is to tilt the playing board 20 in various orientations to cause the playing piece 30 to traverse the maze structures 23A and 23B and to travel through any of the openings 25 to pass between the two maze structures 23A and 23B, requiring the opaque planar playing board 20 to be turned over each time the playing piece passes from one maze structure 23A and 23B on one face to the other maze structure 23A and 23B on the other face in order to view the face and to cause the playing piece 30 to travel from the start location 25 to the finish location 28 in the fastest time.

In FIGS. 1-5, the maze puzzle game 10 comprises a rigid planar board 20 having a rigid maze structure 23A and 23B on each face housed in an enclosed case 27 having a transparent cover 29A and 29B (in FIG. 3) over the top of each of the maze structures 23A and 23B to prevent the playing piece 30 from escaping up out of the top of the maze structure 23A and 23B and to prevent the playing piece from jumping over the walls 26A and 26B and to allow a user to view only one maze structure 23A or 23B on one face of the playing board at a time, when the case is held in at least one hand of a user and tilted and turned over manually.

In FIGS. 1-5 the playing piece 30 comprises a rolling object to travel through the maze by the force of gravity, wherein the playing piece comprises a sphere.

In FIGS. 6-11 the playing board 20 comprises a virtual planar board 21A and 21B and a virtual maze structure 23A and 23B on each face of the virtual playing board 10A both housed in a virtual case represented on a screen 41A and 41B on an electronic device 40, and the playing piece 30A comprises any desired image moving through the mazes by electronic controls.

Figure 6:
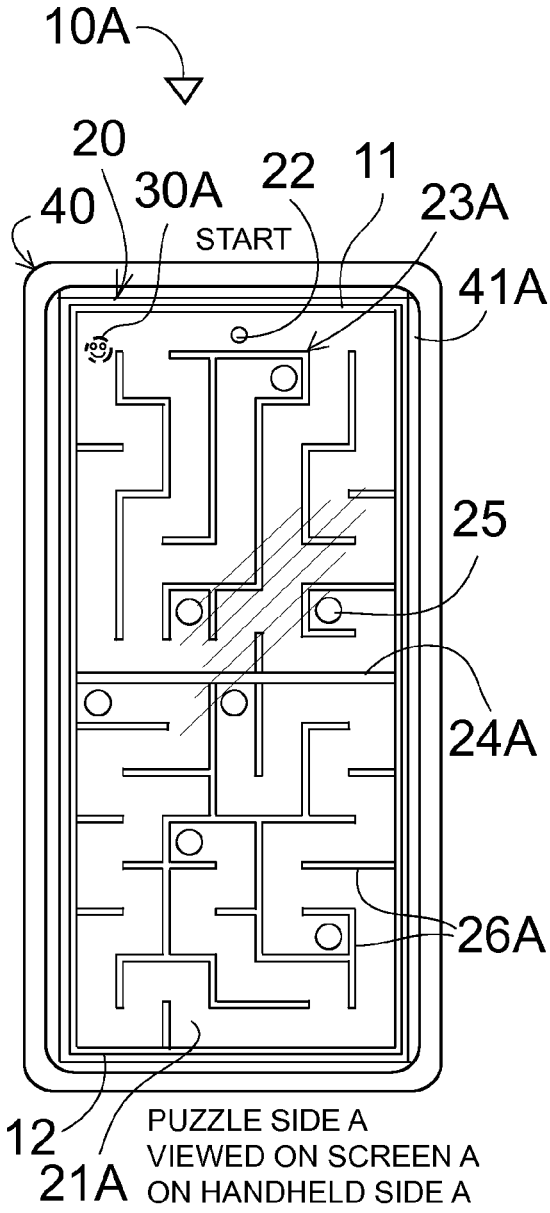
FIG. 6 is a top plan view of a hand held electronic device displaying a virtual playing board of the present invention showing a virtual top maze structure containing the virtual playing piece and the start position at one end of the playing board on an upper screen.
Figure 7:
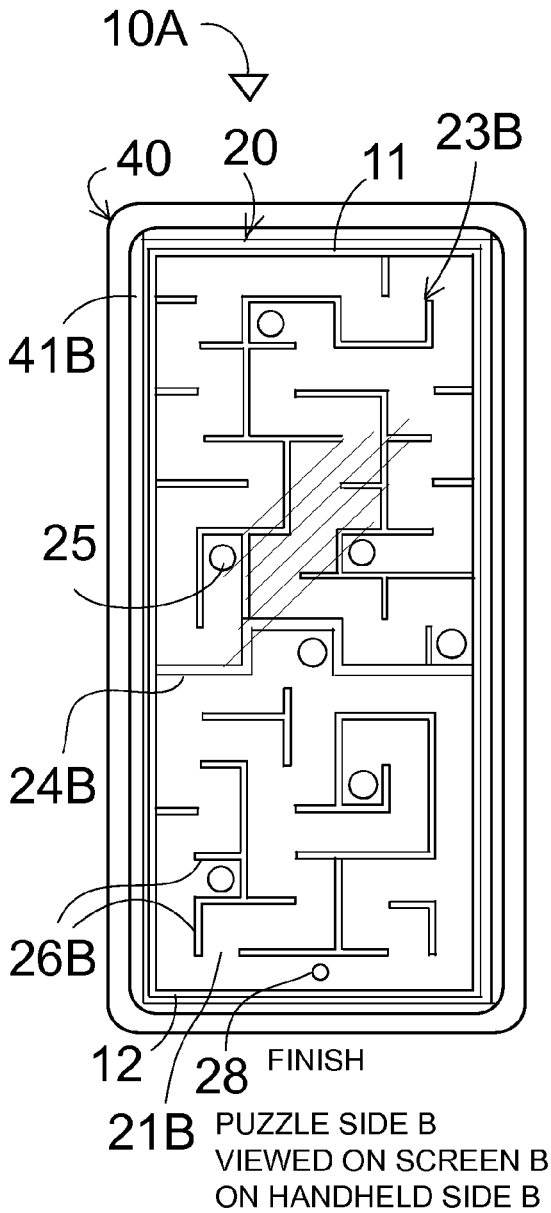
FIG. 7 is a bottom plan view of the hand held electronic device of FIG. 6 displaying the virtual playing board of the present invention showing a virtual bottom maze structure containing the finish position at an opposite end of the playing board on a lower upper screen on the opposing face of the electronic device to that shown in FIG. 6.

In FIGS. 6 and 7, the maze puzzle game 10A is played on a hand-held electronic device 40 comprising a planar electronic case housing electronic circuitry, motion sensors, and electronic controls and a viewing screen 41A and 41B on each of the two faces of the planar electronic case. Each of the viewing screens 41A and 41B bears a visual image of one of the maze structures 23A and 23B as a virtual maze structure and a virtual playing piece 30A in the virtual maze structures 23A and 23B. The planar electronic case 40 is held in at least one hand of a user and the case is tilted and turned over manually to activate the motion sensors which activate the electronic controls to move the virtual playing piece 30A through the virtual maze structures 23A and 23NB to simulate the motion of a physical playing piece 30 (in FIGS. 1-5) moving through a physical maze structure (23A and 23B in FIGS. 1-5) in response to gravity, including falling from one virtual maze structure to another virtual maze structure through the virtual openings 25 which requires a user to turn over the planar electronic case 40 to view the maze structure 23A or 23B containing the playing piece 30.

Figure 8:
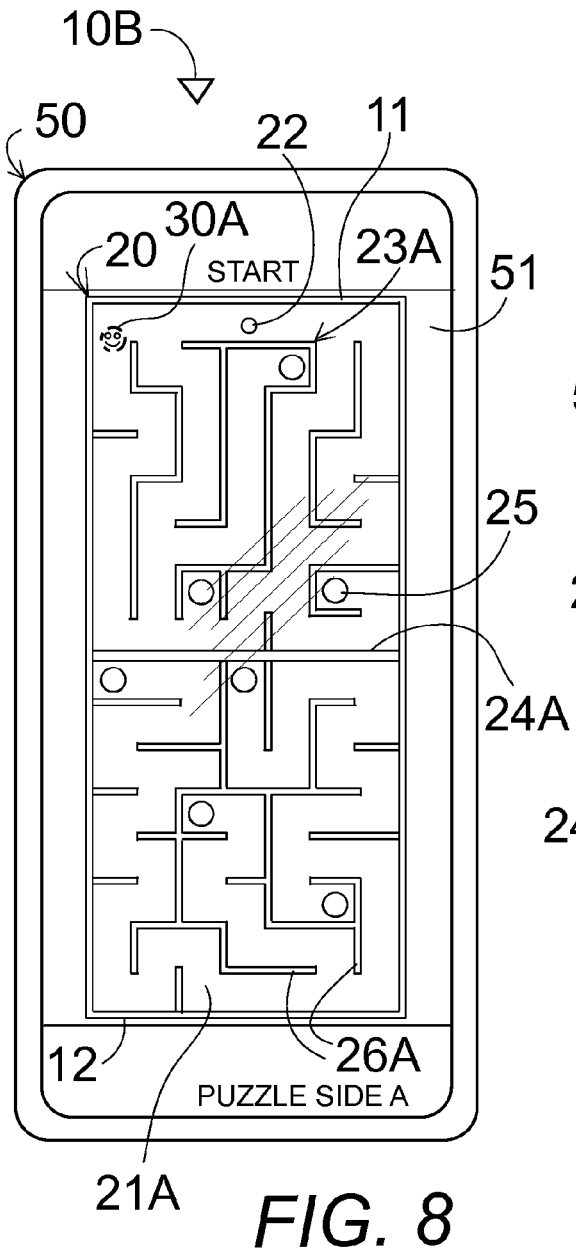
FIG. 8 is a top plan view of another alternate hand held electronic device displaying a virtual playing board of the present invention showing a virtual top maze structure containing the virtual playing piece and the start position at one end of the playing board on a single viewing screen.
Figure 9:
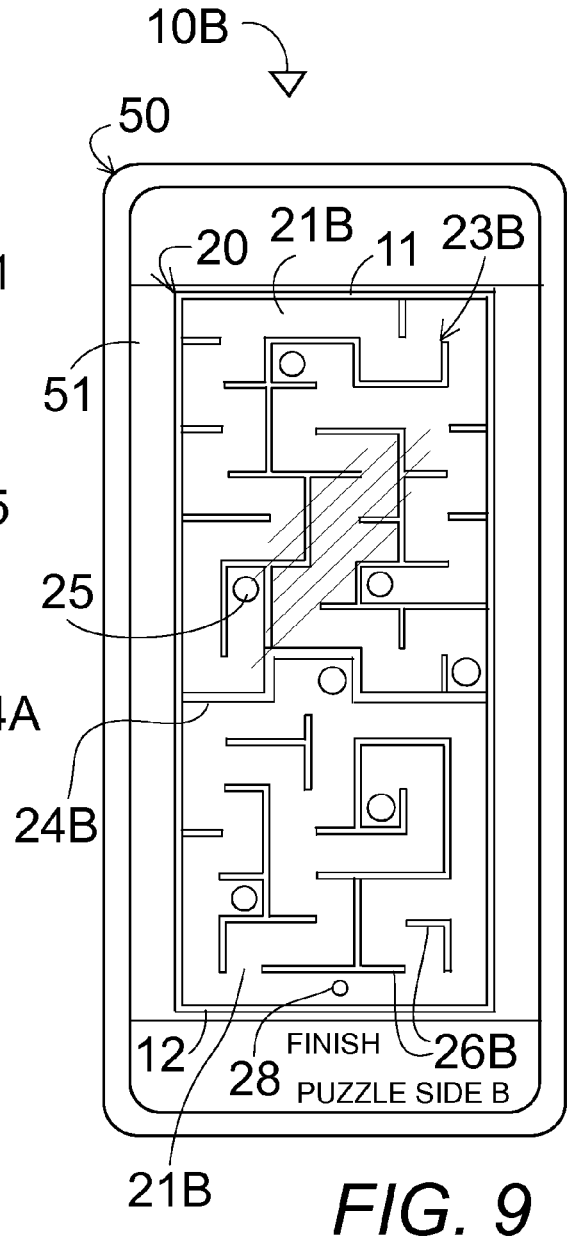
FIG. 9 is a top plan view of the hand held electronic device of FIG. 8 displaying the virtual playing board of the present invention showing a virtual bottom maze structure containing the finish position at an opposite end of the playing board on the single viewing screen.

In FIGS. 8 and 9, the maze puzzle game 10B is played on a hand-held electronic device 50 comprising a planar electronic case housing electronic circuitry, motion sensors, and electronic controls and a single viewing screen 51 on one face of the planar electronic case. The single viewing screen 51 bears a visual image of a virtual playing board 21A and 21B with virtual maze structures 23A and 23B on opposing virtual faces shown one at a time with a selected maze structure 23A or 23B appearing each time the virtual playing piece 30A enters the selected maze structure 23A or 23B. The planar electronic case 50 is held in at least one hand of a user and the case is tilted manually to activate the motion sensors which activate the electronic controls to move the playing piece 30A through the mazes to simulate the motion of an actual physical playing piece 30 (in FIGS. 1-5) in response to gravity, including falling from one maze structure 23A or 23B to another maze structure 23A or 23B through the openings 25, causing the virtual image of one of the maze structures 23A or 23B to appear to flip over to present the other of the maze structures receiving the virtual image of the playing piece 30.

Figure 10:
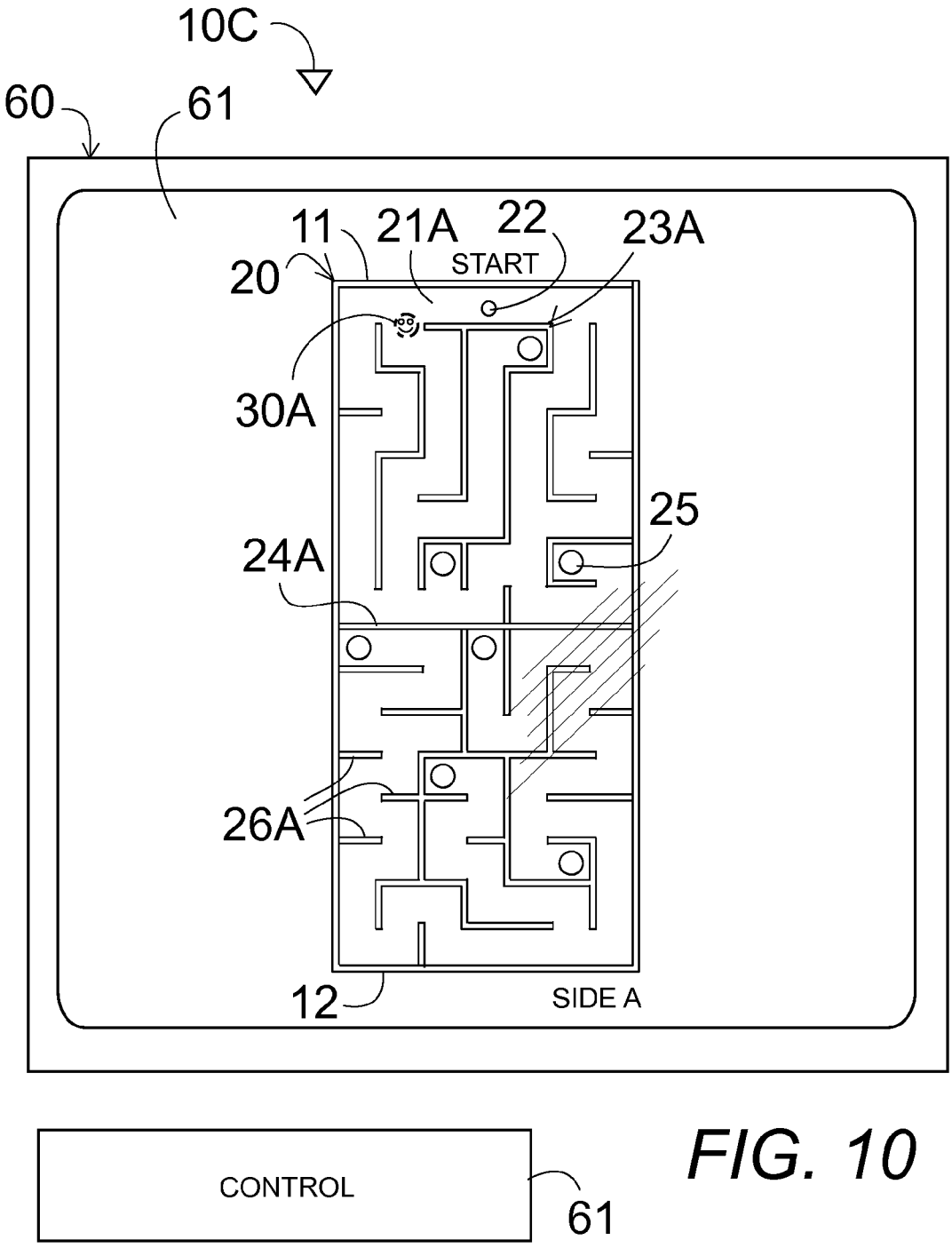
FIG. 10 is an elevational view of another alternate electronic device displaying a virtual playing board of the present invention showing a virtual top maze structure containing the virtual playing piece and the start position at one end of the playing board on a single stationary viewing screen.
Figure 11:
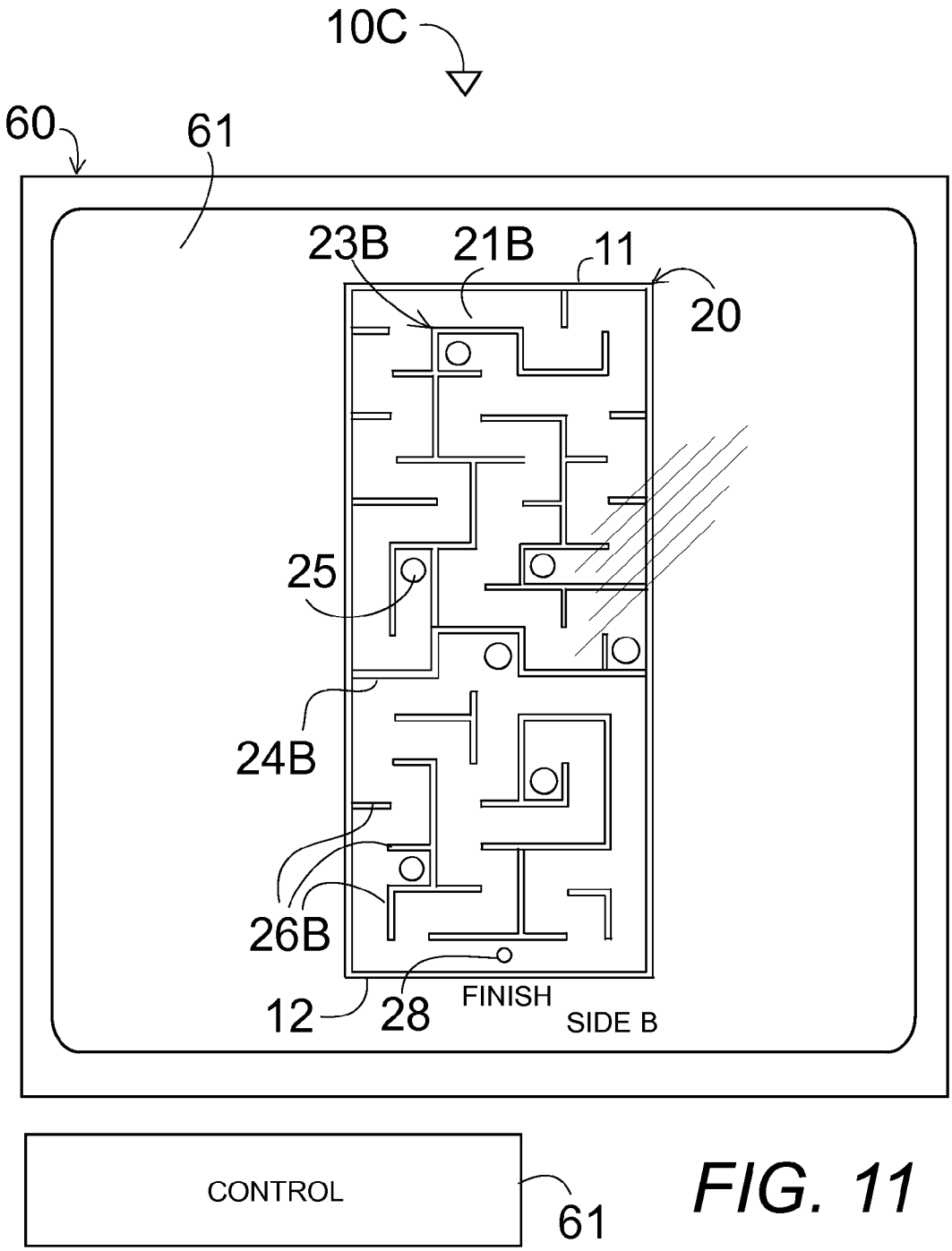
FIG. 11 is an elevational view of the alternate electronic device of FIG. 10 displaying the virtual playing board of the present invention showing a virtual bottom maze structure containing the finish position at an opposite end of the playing board on the single stationary viewing screen.

In FIGS. 10 and 11, the maze puzzle game 10C is played on a computerized electronic device 60 comprising a programmed electronic control 62 communicating with a stationary viewing screen 61 for creating an image of the virtual case 20 on the stationary viewing screen showing a visual image of the maze structures 23A and 23B one at a time. The electronic control 62 is operated by a user to tilt the virtual image of the virtual case 20 on the stationary viewing screen 61 to simulate the tilting of an actual physical case and move the virtual playing piece 30A through the virtual mazes 23A and 23B to simulate the motion of an actual physical playing piece 30 (in FIGS. 1-5) moving through the physical maze structures 23A and 23B (in FIGS. 1-5) in response to gravity, including falling from one virtual maze structure 23A or 23B to another virtual maze structure 23A or 23B through the virtual openings 25. The user is required to manipulate the controls 62 to turn over the virtual case 20 to view the virtual maze structure 23A or 23B containing the virtual playing piece 30.

FIGS. 10 and 11 show the maze puzzle game 10C with electronic controls 62 comprising at least one joy stick.

Figure 3:
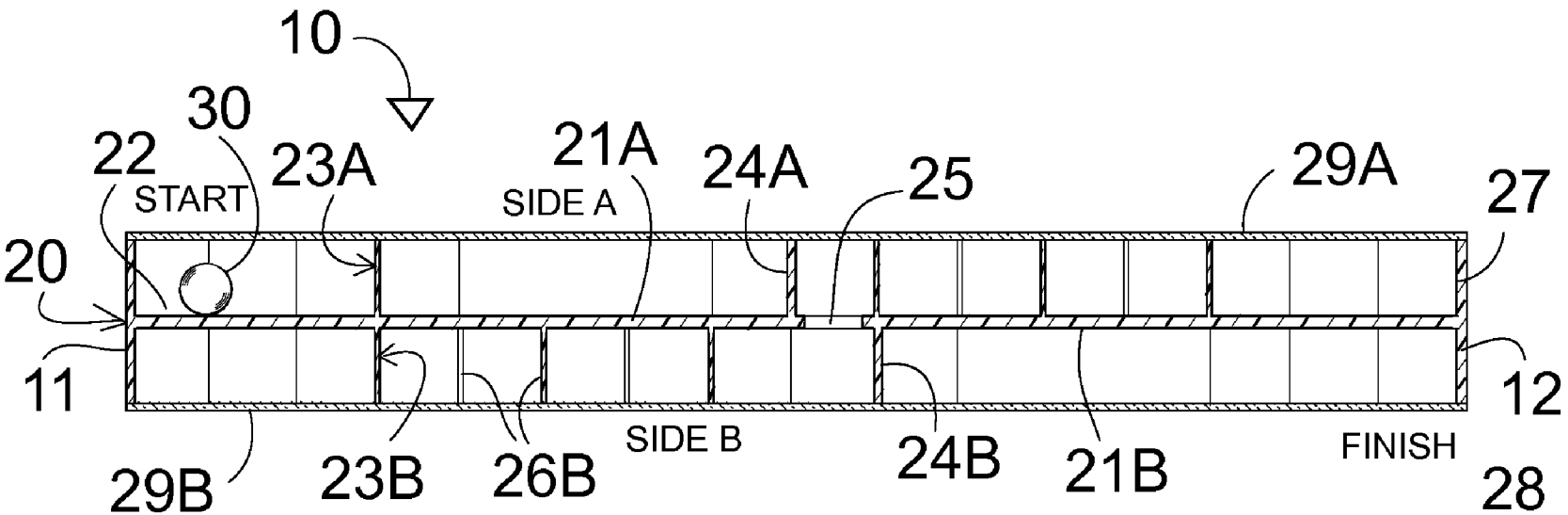
FIG. 3 is a cross-sectional view of the playing board of FIG. 1 taken through 3-3 of FIG. 1 showing the top maze structure containing the playing piece and the bottom maze structure.
Figure 4:
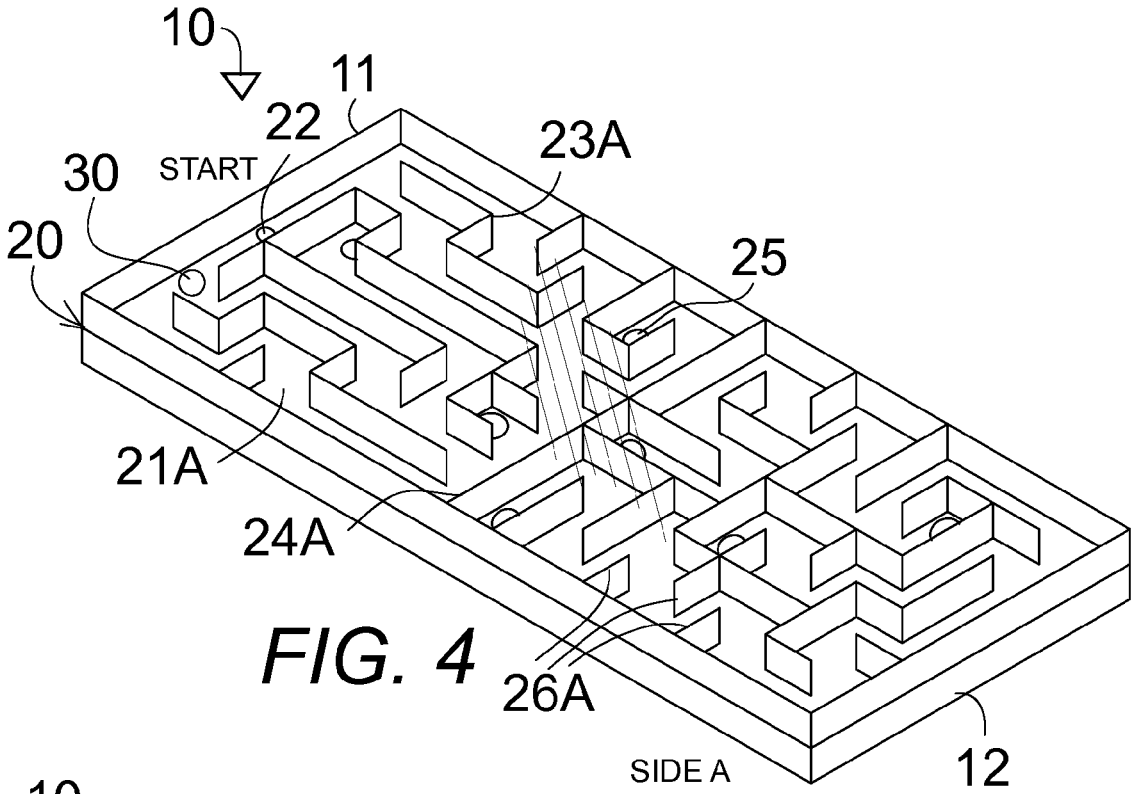
FIG. 4 is a top perspective view of the playing board of FIG. 1 showing the top maze structure containing the playing piece and the start position at one end of the playing board.
Figure 5:
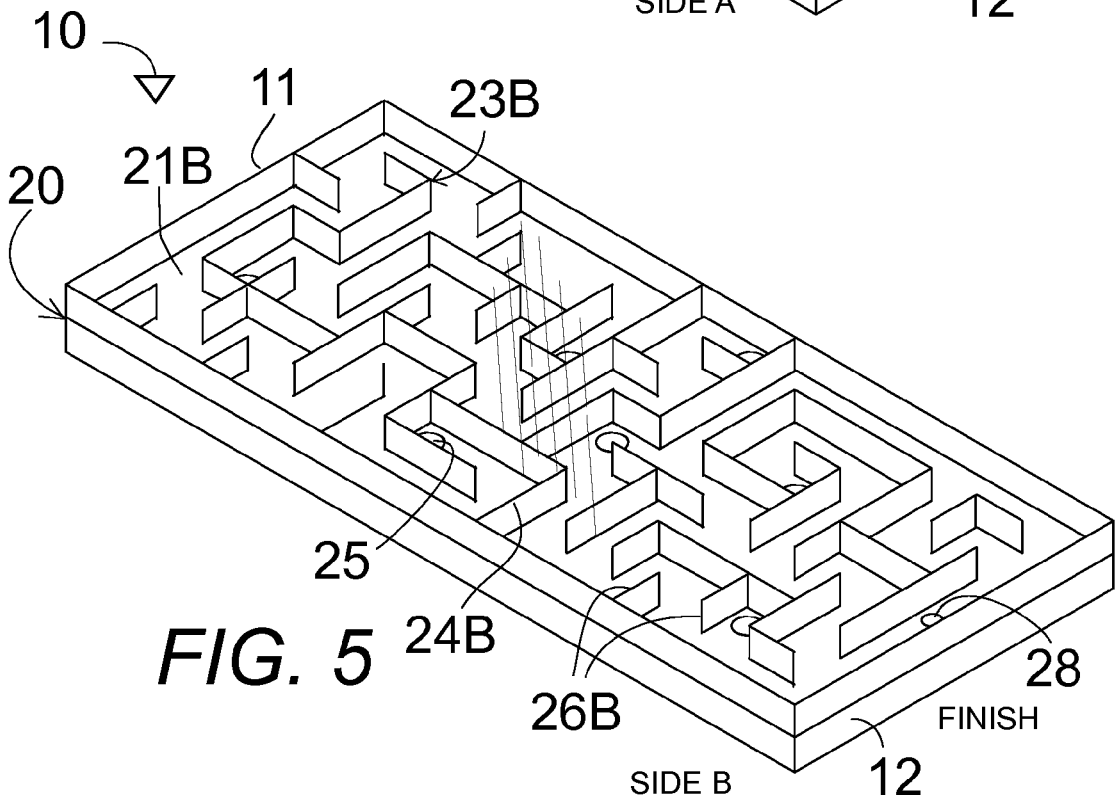
FIG. 5 is a bottom perspective view of the playing board of FIG. 1 showing the bottom maze structure containing the finish position at an opposite end of the playing board.

In a preferred embodiment of the physical hand-held maze puzzle game 10, as shown in FIGS. 1-5, the three components comprise the playing board 20 with built-in maze structures 23A and 23B on opposing faces, as well as built-in edge walls 27, a ball 30, and two clear lens covers 29A and 29B, as shown in FIG. 3. The ball is preferably approximately ¼ inch diameter or less depending on the size of the playing board 21A and 21B, maze structures 23A and 23B, and openings 25 which would be limited in size for a hand-held case. The elements can be made of plastic, glass, or of a metal material.

The center two-sided maze piece which will contain the actual mazes or maze structures 23A and 23B, passages 25, and the two start/stop locations 22/28 may be milled utilizing a solid piece of nylon or similar material. The preferred approximate dimensions are 3 and ⅝ inches wide by 8 and ⅛ inches long and ¾ inches thick. A ⅜ inch wide end mill may be utilized to cut the maze channels to no less than a 5/16 inch depth on each side of the solid block. The holes 25 may be drilled through the block with a 17/64 inch drill bit to allow passage from one maze structure 23A or 23B to the other, and a 5/16 inch drill bit is used to counter sink an inset for the two start/stop positions 22/28. The counter sink cannot go through from one plane to the other. Also a vent hole in each end of the block should be made using a 1/16 inch drill bit to keep the case from clouding up. A thin clear lens material may be cut to size and glued to each side of the maze block after installing the ball.

An alternative to milling a solid material is to utilize a mold or molds to create the maze block from a plastic material.

In use, present invention is a unique puzzle utilizing a network of passages and pathways with two adjoining planes on opposing faces of the playing board. There is a color coded start/stop 22/28 position inset in each of the two planes. The objective of the puzzle is to locate the ball 30 in one of the two start/stop positions, and then as quickly as possible try to relocate the ball to the other color coded start/stop position on the other side of the board. After completing the maze, the stop (or finish) position becomes the start position and the player tries to relocate the ball back to the original start position that then becomes the new stop or finish position. Several puzzles can be utilized by several players to race and determine the quickest player.

It is understood that the preceding description is given merely by way of illustration and not in limitation of the invention and that various modifications may be made thereto without departing from the spirit of the invention as claimed.

What is claimed is:

1. A three dimensional puzzle maze game comprising:

a playing board comprising an opaque planar surface having two opposing faces and a maze structure on each of the two opposing faces of the playing board, each of the maze structures comprising spaced walls in various orientations and of various lengths to create passageways along the playing board between the spaced walls with some dead end passageways and some through passageways communicating with other passageways; a playing piece to move on the playing board through each of the maze structures along the passageways, the playing piece moving in a direction of a downward tilting of the playing board; the playing board having a plurality of openings therethrough at various locations to admit the playing piece to pass from a first maze structure on a first face on one side of the playing board to a second maze structure on a second face on the opposing side of the playing board and back; edge walls around the outer perimeter of each face to define the peripheral edge limitations of the maze structure; a start location at a first end of the playing board in the first maze structure on the first face for placing the playing piece to start the passage of the playing piece in motion, and a finish location at a second end of the playing board in the second maze structure on the second face; each of the maze structures having a barrier wall extending between two opposing side walls midway between two ends of each of the maze structures to prevent the playing piece from moving directly from one end of each of the maze structures to the other end of the same maze structure on the same face, the barrier wall on one face positioned out of vertical alignment with the barrier wall on the other face, thereby requiring the playing piece to pass back and forth through various openings between the maze structures on the two faces and traverse the maze structures in order to move from the start location in the first maze structure on the first face to land on the finish location in the second maze structure on the on the second face at the opposing end of the planar playing board; the object being to tilt the playing board in various orientations to cause the playing piece to traverse the maze structures and to travel through any of the openings to pass between the two maze structures, requiring the opaque planar playing board to be turned over each time the playing piece passes from one maze structure on one face to the other maze structure on the other face in order to view the face, to cause the playing piece to travel from the start location to the finish location in the fastest time.

2. The maze puzzle game of claim 1 wherein the playing board comprises a rigid planar board having a rigid maze structure on each face housed in an enclosed case having a transparent cover over a top of each of the maze structures to prevent the playing piece from escaping up out of the top of the maze structure and to prevent the playing piece from jumping over the walls and to allow a user to view only one maze structure on one face of the playing board at a time, the case held in at least one hand of a user and the case tilted and turned over manually.

3. The maze puzzle game of claim 2 wherein the playing piece comprises a rolling object to travel through the maze by the force of gravity.

4. The maze puzzle game of claim 3 wherein the playing piece comprises a sphere.

5. The maze puzzle game of claim 1 wherein the playing board comprises a virtual planar board and a virtual maze structure on each face of the virtual playing board both housed in a virtual case represented on a screen on an electronic device, and the playing piece comprises any desired image moving through the mazes by electronic controls.

6. The maze puzzle game of claim 5 wherein the electronic device comprises a hand held electronic device comprising a planar electronic case housing electronic circuitry, motion sensors, and electronic controls and a viewing screen on each of the two faces of the planar electronic case, each of the viewing screens bearing a visual image of one of the maze structures as a virtual maze structure and a virtual playing piece in the virtual maze structures, the planar electronic case held in at least one hand of a user and the case tilted manually and turned over manually to activate the motion sensors to activate the electronic controls to move the virtual playing piece through the virtual maze structures to simulate the motion of a physical playing piece moving through a physical maze structure in response to gravity including falling from one virtual maze structure to another virtual maze structure through the virtual openings which requires a user to turn over the planar electronic case to view the maze structure containing the playing piece.

7. The maze puzzle game of claim 5 wherein the electronic device comprises a hand held electronic device comprising a planar electronic case housing electronic circuitry, motion sensors, and electronic controls and a single viewing screen on one face of the planar electronic case, the single viewing screen bearing a visual image of a virtual playing board with virtual maze structures on opposing virtual faces shown one at a time, a selected maze structure appearing each time the virtual playing piece enters the selected maze structure, the planar electronic case held in at least one hand of a user and the case tilted manually to activate the motion sensors to activate the electronic controls to move the playing piece through the mazes to simulate the motion of an actual physical playing piece in response to gravity including falling from one maze structure to another maze structure through the openings causing the virtual image of one of the maze structures to appear to flip over to present the other of the maze structures receiving the virtual image of the playing piece.

8. The maze puzzle game of claim 5 wherein the electronic device comprises a computerized electronic device comprising a programmed electronic control communicating with a stationary viewing screen for creating an image of the virtual case on the stationary viewing screen showing a visual image of the maze structures one at a time, the electronic control operated by a user to tilt the virtual image of the virtual case on the stationary viewing screen to simulate the tilting of an actual physical case to move the virtual playing piece through the virtual mazes to simulate the motion of an actual physical playing piece moving through the physical maze structures in response to gravity including falling from one virtual maze structure to another virtual maze structure through the virtual openings, requiring a user to manipulate the controls to turn over the virtual case to view the virtual maze structure containing the virtual playing piece.

9. The maze puzzle game of claim 8 wherein the electronic controls comprise at least one joy stick.

* * * * *